US009121565B2

(12) United States Patent
Marcori et al.

(10) Patent No.: US 9,121,565 B2
(45) Date of Patent: Sep. 1, 2015

(54) AUTOMOTIVE LIGHTING UNIT

(75) Inventors: Franco Marcori, Moggio Udinese (IT); Sara Paroni, Codroipo (IT); Marco Svettini, Udine (IT)

(73) Assignee: Automotive Lighting Italia S.p.A., Venaria Reale (IT)

( * ) Notice: Subject to any disclaimer, the term of this patent is extended or adjusted under 35 U.S.C. 154(b) by 10 days.

(21) Appl. No.: 14/001,555

(22) PCT Filed: Mar. 5, 2012

(86) PCT No.: PCT/IB2012/051034

§ 371 (c)(1), (2), (4) Date: Nov. 7, 2013

(87) PCT Pub. No.: WO2012/120441

PCT Pub. Date: Sep. 13, 2012

(65) Prior Publication Data

US 2014/0056016 A1 Feb. 27, 2014

(30) Foreign Application Priority Data

Mar. 4, 2011 (IT) ..... TV2011A0034

(51) Int. Cl.
*F21V 9/00* (2006.01)
*F21S 8/10* (2006.01)

(52) U.S. Cl.
CPC ..... *F21S 48/2225* (2013.01); *F21S 48/215* (2013.01); *F21S 48/255* (2013.01)

(58) Field of Classification Search
CPC . F21S 48/215; F21S 48/2237; F21S 48/1241; F21S 48/2281; F21S 48/00; F21S 48/115; F21S 48/225; F21S 48/2225
USPC ..... 362/459, 487, 509, 511, 516, 538, 543
See application file for complete search history.

(56) References Cited

FOREIGN PATENT DOCUMENTS

| | | |
|---|---|---|
| EP | 1243467 | 9/2002 |
| EP | 1418087 | 5/2004 |
| EP | 1898147 | 3/2008 |
| FR | 2934353 | 1/2010 |

OTHER PUBLICATIONS

PCT International Search Report and Written Opinion of the International Searching Authority, Prepared by Stirnweiss, Pierre; dated Aug. 7, 2012; pp. 1-7.

*Primary Examiner* — Meghan Dunwiddie
(74) *Attorney, Agent, or Firm* — McCarter & English, LLP

(57) ABSTRACT

An automotive light including a rear shell which is substantially tub-shaped and is structured so as to be fixed onto the vehicle body; a front lenticular half-shell which is provided with at least one portion made of transparent or semitransparent material, and is arranged to close the mouth of the rear shell; and at least a first main light source which is structured so as to emit light when electricity powered, and is placed within the rear shell in such a position as to backlight a corresponding transparent or semitransparent portion of the front lenticular half-shell; the automotive light further including at least one light-guiding section-bar made of light-conducting material, which is placed on the bottom of a corresponding slot or groove specifically obtained within the rear shell; and at least one auxiliary light source which is structured so as to emit light when electricity powered, and is placed within the rear shell so as to direct the emitted light directly into the body of the light-guiding section-bar; the light-guiding section-bar made of light-conducting material being provided with a cross section substantially circular or elliptic in shape, and with a longitudinal flat bevel facing the bottom of the slot or groove and structured so as to cause the light travelling in the light-guiding section-bar to exit towards the transparent or semitransparent portion of the lenticular half-shell above the light-guiding section-bar.

12 Claims, 3 Drawing Sheets

AUTOMOTIVE LIGHTING UNIT

RELATED APPLICATIONS

This application is a national stage application filed under 35 USC 371 of PCT/IB2012/051034, filed Mar. 5, 2012, which claims the benefit of an Italian Application No. TV2011A000034, filed Mar. 4, 2011, all of which are incorporated herein, in entirety, by reference.

TECHNICAL FIELD

The present invention relates to an automotive light.

More in detail, the present invention relates to a rear light for cars and the like, to which use the following description will explicitly refer without loss of generality.

BACKGROUND ART

As known, rear lights of cars usually consist of rigid rear shell which is substantially tub-shaped, and is structured so to be stably recessed within a dedicated space obtained in the rear part of the vehicle body; of a front lenticular half-shell which is at least partially made of a transparent or semitransparent plastic material, usually colored, and which is arranged to close the mouth of the shell so to emerge from the vehicle body; of a series of cup-shaped bodies having a substantially parabolic profile, which are placed within the rear shell with the concavity facing the front lenticular half-shell, so as to be each aligned with a respective transparent or semitransparent window of the front lenticular half-shell; and of a series of incandescent light bulbs, each of which is placed close to the bottom of a respective cup-shaped body. The inner surface of each cup-shaped body is further mirror-finished so as to reflect/direct the light emitted by the light bulb inside the cup-shaped body towards the corresponding transparent or semitransparent window of the front lenticular half-shell.

In recent years, moreover, the rear lights of cars have increasingly been integrated within the outer profile of the vehicle body, getting to cover the two body edges that connect the rear of the car body to the two side flanks thereof.

Along with the integration of the rear lights within the profile of the vehicle body with the consequent adoption of lenticular half-shells with particularly complex three-dimensional shapes, the major car manufacturers started to require rear lights where the front lenticular half-shell is provided with transparent or semitransparent windows having a narrow elongated shape, which often extend along the whole periphery of the lenticular half-shell.

In order to be able to evenly backlight these band-like transparent or semitransparent windows, the major manufacturers of rear lights for cars decided to replace the traditional incandescent light bulbs with light emitting diode arrays, traditionally referred to as LEDs. LEDs indeed have significantly smaller dimensions than incandescent light bulbs for automotive use, and allow flat light sources to be obtained, which copy the shape of transparent or semitransparent windows to be backlighted, and therefore may be placed right underneath the front lenticular half-shell of the light, thus locally following the profile thereof.

Obviously, using a large amount of light emitting diodes implied a significant increase in the overall costs of manufacturing rear car lights.

In order to at least partially contain this increase in manufacturing costs, some manufacturers decided to backlight the transparent or semitransparent windows of the front lenticular half-shell by means of one or more light-guiding bars or strips made of light-conducting material, with a square section and a nominal thickness of more than 5 millimeters, each of which extends underneath the front lenticular half-shell, at the transparent or semitransparent window to be backlighted, and receives the light from one or more LEDs abutting on one of the two strip ends, usually away from the transparent or semitransparent window to be backlighted.

In other words, the light-guiding bars or strips are recessed within grooves specifically obtained in the rear shell of the light, and are structured so as to channel the light towards the front lenticular half-shell, and then make the light propagating into the strip come out in a controlled and progressive manner close to the half-shell. Thereby, the light-guiding bar or strip is capable of backlighting the transparent or semitransparent window which is right on top.

While the use of light-guiding strips ensures a significant cost saving compared to a massive use of LEDs, it does not allow the front lenticular half-shell, or better the transparent or semitransparent windows of the front lenticular half-shell, to be backlighted with a light having the same intensity as that generated by an array of LEDs, since the light propagating into the body of the light-guiding bar or strip is naturally subjected to scattering and absorption phenomena which quickly reduce the intensity of the light coming out of the strip. These physical phenomena actually prevent the optimal backlighting of transparent or semitransparent windows which are longer than 8-10 centimeters.

DISCLOSURE OF INVENTION

It is the object of the present invention to solve the typical drawbacks of current systems of backlighting the front lenticular half-shell by means of light-guiding strips made of a light-conducting material.

According to these objects, a rear automotive light is provided according to the present invention as set forth in claim 1 and preferably, but not necessarily, in any one of the dependent claims.

BRIEF DESCRIPTION OF THE DRAWINGS

The present invention will now be described with reference to the accompanying drawings, which show a non-limiting example thereof, in which:

FIG. 1 shows an exploded axonometric view, with parts removed for clarity, of a rear light for cars made according to the teachings of the present invention; whereas

BEST MODE FOR CARRYING OUT THE INVENTION

Figure 1:
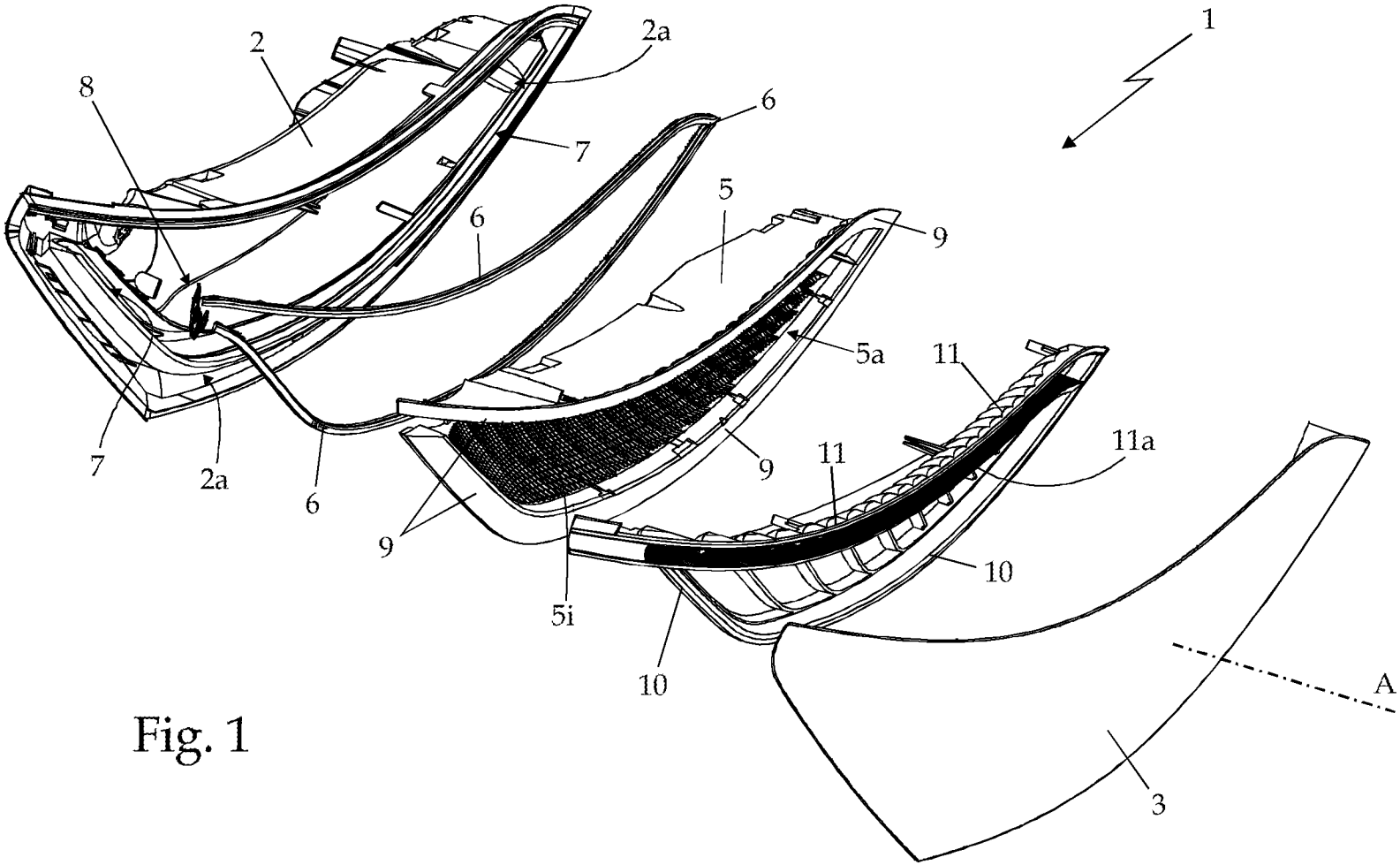
Figure 2:
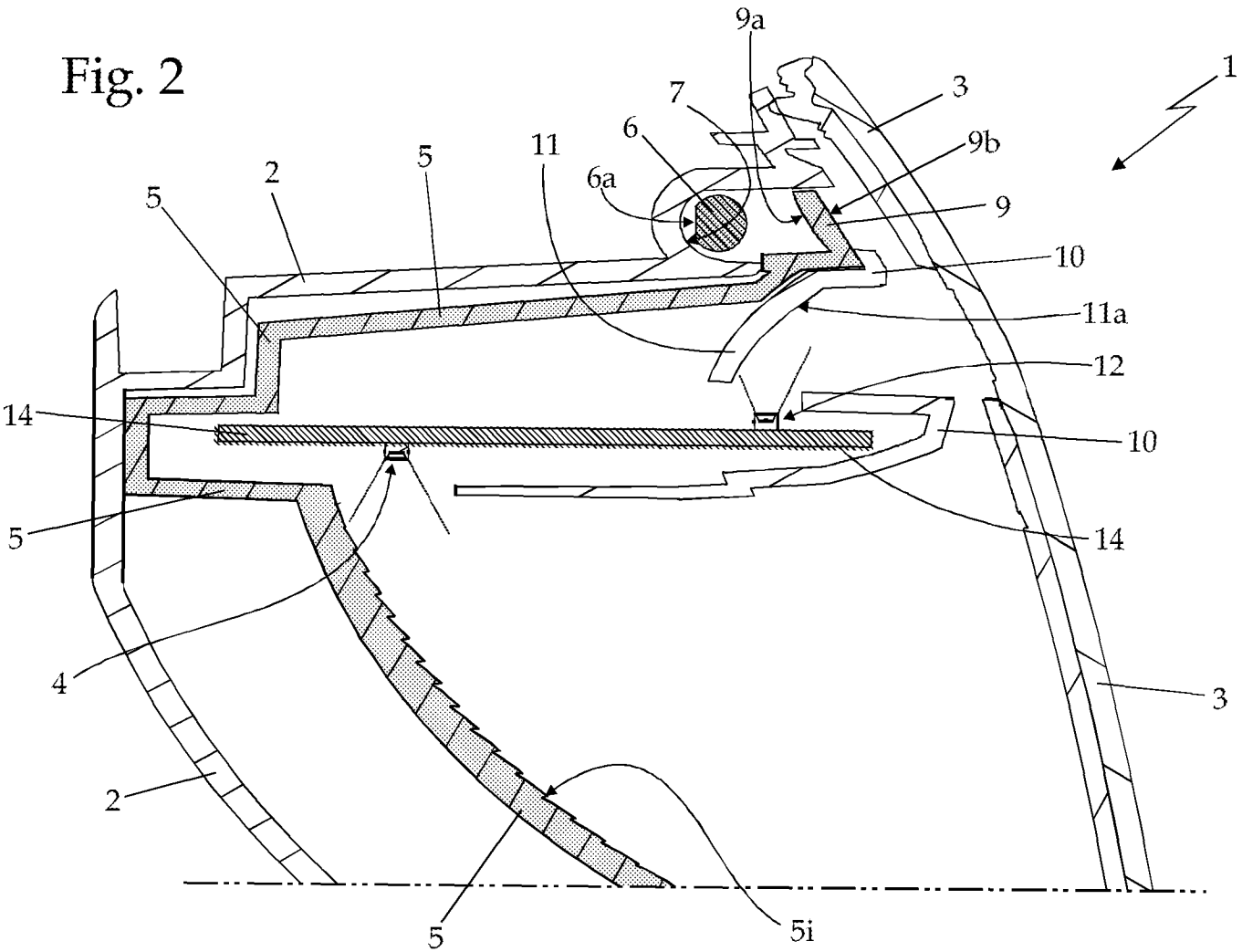
FIGS. 2 and 3 show two sectional views of the automotive light shown in FIG. 1.
Figure 3:
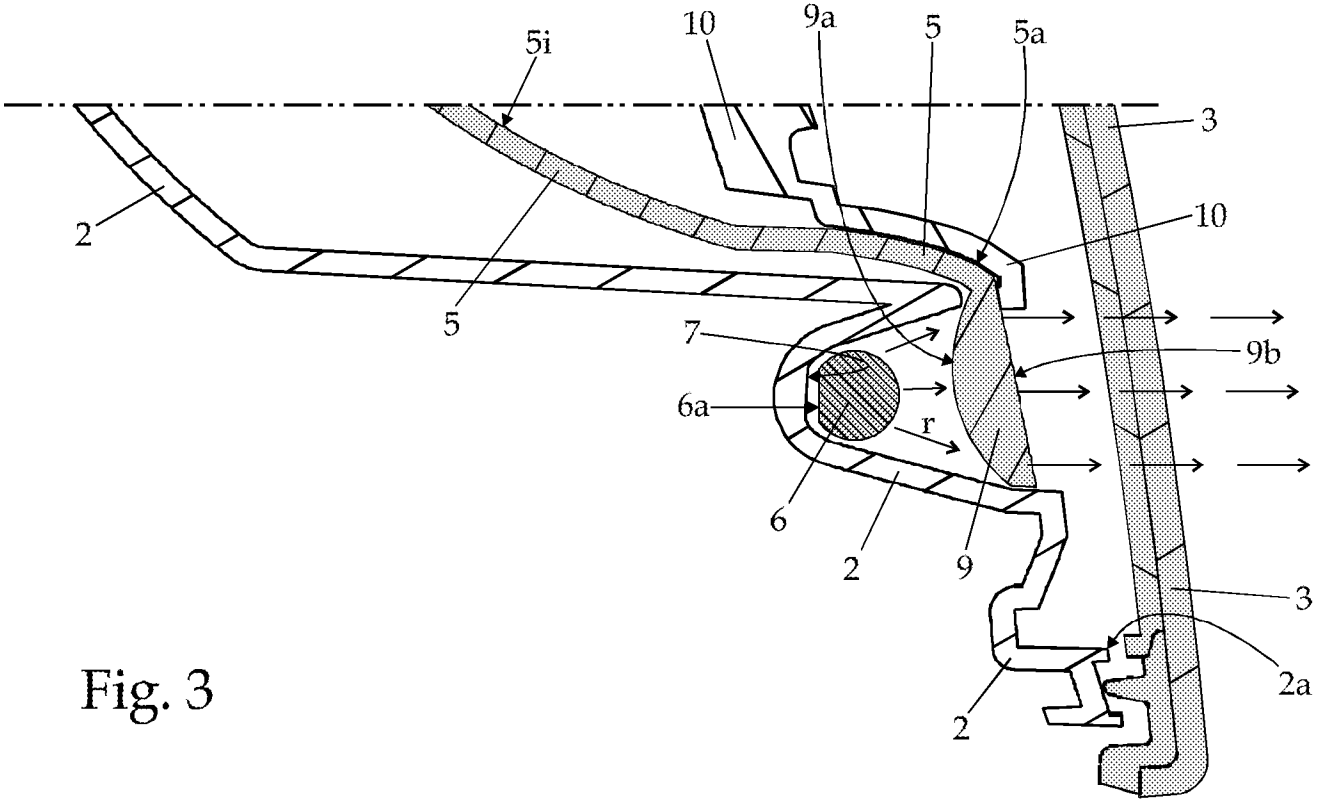

With reference to FIGS. 1, 2 and 3, reference numeral 1 indicates as a whole an automotive light which is particularly adapted to be fixed onto the rear of the body of a car, motorcycle or the like, i.e. a rear automotive light.

More in detail, in the example shown, the automotive light 1 is preferably but not necessarily structured so as to be recessed within the car rear and comprises:

a stiff rear shell 2 which is substantially tub-shaped and is structured so as to be recessed within a space specifically obtained in the rear of the vehicle body;

a front lenticular half-shell 3 which is at least partially provided with a portion made of transparent or semi-transparent material, optionally colored, and is arranged to close mouth 2*a* of the rear shell 2, so as to preferably but not necessarily also emerge from the vehicle body (not shown); and at least one main light source 4 which is structured so as to emit light when electricity powered, and which is arranged within the rear shell 2 in such a position as to backlight a corresponding transparent or semitransparent portion of the front lenticular half-shell.

Obviously, in a different embodiment, the rear shell 2 may be structured so as to be simply fixed jut-wise on the rear part of the vehicle body.

The automotive light 1 is preferably further provided with at least one reflecting body 5 which is placed within the rear shell 2 so as to surround the main light source 4, and is structured so as to divert, direct and/or reflect the light emitted by the main light source 4 towards the transparent or semitransparent portion of the front lenticular half-shell 3 which is intended to be backlighted by the main light source 4.

In particular, in the example shown, mouth 2*a* of the rear shell 2 preferably but not necessarily has a substantially triangular shape with curved sides; and the rear shell 2 is preferably but not necessarily entirely made of an opaque plastic material by means of an injection molding process.

On the other hand, the front lenticular half-shell 3 has a dished shape complementary to that of mouth 2*a* of the rear shell 2 so as to completely close/seal the rear shell 2, and is preferably but not necessarily entirely made of a transparent or semitransparent plastic material, preferably also with transparent or semitransparent portions of a different color, by means of an injection molding process.

In particular, in the example shown, the front lenticular half-shell 3 is made of transparent or semitransparent polycarbonate or polymethyl-methacrylate.

On the other hand, with reference to FIGS. 1 and 2, the reflecting body 5 preferably but not necessarily consists of a cup-shaped body 5 which is recessed within the rear shell 2 with the concavity facing the front lenticular half-shell 3, or better a corresponding transparent or semitransparent portion of the lenticular half-shell 3. The main light source 4 is placed close to the bottom of the cup-shaped body 5, and the inner surface 5*i* of the cup-shaped body 5 is preferably but not necessarily metallized or otherwise mirror-finished, so as to reflect the light emitted by the light source 4 towards the transparent or semitransparent portion of the lenticular half-shell 3 above the mouth 5*a* of the cup-shaped body 5.

Moreover, the main light source 4 preferably but not necessarily consists of a series of light emitting diodes, traditionally referred to as LEDs, which are fixed next to one another, on a support and supply board which is structured so as to be preferably fixed onto the cup-shaped body 5, with the light emitting diodes facing mouth 5*a* of the cup-shaped body 5 and/or to the inner surface 5*i* of the cup-shaped body 5.

With reference to FIGS. 1 and 2, the automotive light 1 further comprises at least one light-guiding section-bar 6 made of light-conducting material, which is placed on the bottom of a corresponding elongated slot or groove 7 specifically obtained in the rear shell 2, right underneath a corresponding transparent or semitransparent portion of the front lenticular half-shell 3, optionally colored; and at least one LED light source 8 or the like, which is structured so as to emit light when electricity powered, and is placed within the rear shell 2 close to at least one of the two ends of the light-guiding section-bar 6, so as to direct the emitted light directly into the body of the light-guiding section-bar 6. The light then propagates into the light-guiding section-bar 6 by virtue of the same physical principles which regulate the light propagation into optic fiber cables.

In particular, in the example shown, the light-guiding section-bar 6 is preferably but not necessarily made of Plexiglas, transparent polycarbonate or other similar plastic material.

Unlike the automotive lights currently known, however, in the automotive light 1 the light-guiding section-bar 6 made of light-conducting material has a cross section substantially circular or elliptic in shape, and on the opposite side of the front lenticular half-shell 3, i.e. on the portion directly facing the bottom of the elongated slot or groove 7, it has a longitudinal flat bevel 6*a* which is structured so as to cause the light travelling in the light-guiding section-bar 6 to exit in a controlled and progressive manner, towards the transparent or semitransparent portion of the lenticular half-shell 3 above the light-guiding section-bar 6.

In other words, the longitudinal flat bevel 6*a* extends along the body of the light-guiding section-bar 6 so as to be locally aligned with the transparent or semitransparent portion of the lenticular half-shell 3 to be backlighted, and is provided with light extraction means which are structured so as to cause the light to exit in a controlled and progressive manner from the curved surface of the light-guiding section-bar 6 towards the lenticular half-shell 3 right above.

In particular, in the example shown, the surface of the longitudinal flat bevel 6*a* of the light-guiding section-bar 6 has a sawtooth-shaped cross profile with a height lower than 0.8 millimeters and a pitch smaller than 3 millimeters, which is capable of deviating the light rays outwards from the body of the light-guiding section-bar 6, which reach/hit the surface of the longitudinal flat bevel 6*a* at these teeth by bouncing within the body of the light-guiding section-bar 6.

Alternatively, the controlled exit of the light trapped in the body of the light-guiding section-bar 6 may also be obtained by subjecting the surface of the longitudinal flat bevel 6*a* to a surface abrasion (sandblasting), glazing or silk-screen printing process, so as to locally increase the surface roughness of the surface of the longitudinal flat bevel 6*a*.

With reference to FIGS. 1, 2 and 3, in addition to the above, the automotive light 1 is further provided with an intermediate converging lenticular body 9 made of transparent or semitransparent material which is arranged to close the elongated slot or groove 7 accommodating the light-guiding section-bar 6, so as to be crossed by the light coming out from the elongated slot or groove 7, and is shaped so as to divert/focus/collimate the light rays r coming out from the light-guiding section-bar 6 in a substantially radial direction, in a new direction locally substantially perpendicular to the surface of the corresponding transparent or semitransparent portion of the front lenticular half-shell 3.

The intermediate lenticular body 9 is preferably further shaped so as to divert/focus/collimate the light rays r coming out from the light-guiding section-bar 6 in a substantially radial direction, in a new direction which is also locally substantially parallel to the reference optical axis A of the light, in turn substantially parallel to the longitudinal axis of the vehicle.

More in detail, with reference to FIGS. 2 and 3, the intermediate lenticular body 9 is shaped so that its rear face 9*a*, i.e. the face facing the light-guiding section-bar 6, has a convex profile which locally varies according to the shape of the segment of light-guiding section-bar 6 right underneath, and possibly also according to the spatial orientation of the same segment of light-guiding section-bar 6 with respect to the reference optical axis A of the light, so that the light rays coming from the front face 9*b* of the intermediate lenticular body 9 are locally substantially perpendicular to the surface of the front lenticular half-shell 3 and possibly also substantially parallel to the reference optical axis A of the light. On the other hand, the front face 9*b* of the intermediate lenticular body 9, i.e. the face facing the lenticular half-shell 3, is structured so as to substantially evenly distribute the light rays coming out from the intermediate lenticular body 9, so that the intensity of the light per surface unit is substantially even along the whole front face 9*b*, so as to backlight the whole transparent or semitransparent portion of the lenticular half-shell 3 right above the intermediate lenticular body 9 with a light having a substantially even intensity.

More in detail, the front face 9*b* of the intermediate lenticular body 9 is preferably structured so as to randomly diffuse/distribute the light coming out from the body of the light-guiding section bar 6, so as to homogeneously backlight the whole transparent or semitransparent portion of the lenticular half-shell 3 above the intermediate lenticular body 9.

In particular, in the example shown, the intermediate lenticular body 9 is preferably but not necessarily made of a transparent or semitransparent plastic material, such as for example polycarbonate or polymethyl-methacrylate, by means of an injection molding process; and the surface of the front face 9*b* of the intermediate lenticular body 9 is preferably embossed, i.e. provided with a multitude of recesses or blind holes which are smaller than one millimeter, capable of randomly diffusing the light rays that reach the front face 9*b* once they have crossed the intermediate lenticular body 9.

Alternatively, the random diffusion of the light coming out from the front face 9*b* of the intermediate lenticular body 9 may also be obtained by subjecting the surface of the front face 9*b* to a surface abrasion (sandblasting), glazing or silk-screen printing process so as to locally increase the surface roughness of the surface of the intermediate lenticular body 9.

In a different embodiment, instead, the random diffusion of the light coming out from the front face 9*b* of the intermediate lenticular body 9 may be obtained by making the whole intermediate lenticular body 9 of an opaline white semitransparent plastic material, such as for example polycarbonate or polymethyl-methacrylate, or of a semitransparent plastic material that incorporates a multitude of microspheres therein, which have a diameter smaller than a tenth of millimeter and are capable of randomly diffusing/reflecting the light crossing the intermediate lenticular body 9.

In particular, in the example shown and with reference to FIGS. 1 and 3, the elongated slot or groove 7 extends into the rear shell 2 substantially along the whole periphery of mouth 2*a*, and the intermediate lenticular body 9 is substantially annular in shape, thus substantially copying the shape of the elongated slot or groove 7. The light-guiding section-bar 6 preferably but not necessarily extends underneath the front lenticular half-shell 3 substantially along the whole peripheral edge of the half-shell, so as to backlight a corresponding transparent or semitransparent portion of the lenticular half-shell 3 which is substantially annular in shape.

More in detail, the light-guiding section-bar 6 is substantially V-shaped, with the ends bent towards each other, and the LED light source 8 is arranged within the rear shell 2, substantially at a vertex of mouth 2*a*, so as to face the two ends of the V-shaped light-guiding section-bar 6.

With reference to FIGS. 1, 2 and 3, the cup-shaped body 5 is shaped instead so as to be recessed within the central portion of the rear shell 2, delimited by the elongated slot or groove 7, and the intermediate lenticular body 9 preferably but not necessarily consists of a protruding peripheral flange 9 which juts out of mouth 5*a* of the cup-shaped body 5 to fully cover the immediately adjacent entrance of the elongated slot or groove 7.

In other words, in the example shown, the intermediate lenticular body 9 is integrally made in one piece with the cup-shaped body 5, and the cup-shaped body 5 consists of a half-shell which is entirely made of a transparent or semitransparent plastic material, optionally colored, and has at least one part of its inner convex surface 5*i* which is mirror-finished so as to reflect the incident light towards the transparent or semitransparent portion of the lenticular half-shell 3 to be backlighted by the light source 4.

Preferably but not necessarily, such a half-shell is further made by means of an injection molding process.

In particular, in the example shown, the cup-shaped body 5 and the intermediate lenticular body 9 are integrally made in one piece of transparent polycarbonate or polymethyl-methacrylate, and the whole inner surface 5*i* of the cup-shaped body 5 is metallized and mirror-finished so as to reflect all the light emitted by the light source 4 towards the opening of the cup-shaped body 5.

Moreover, with reference to FIGS. 1 and 2, the automotive light 1 is preferably but not necessarily provided with a front frame 10 which is directly recessed within mouth 5*a* of the cup-shaped body 5, and is provided with a dished reflecting fin 11 which extends into the cup-shaped body 5. The inner surface 11*a* of the reflecting fin 11, i.e. the surface facing the front lenticular half-shell 3, is shaped and mirror-finished so as to reflect the incident light towards a corresponding transparent or semitransparent portion of the lenticular half-shell 3, optionally colored; and the automotive light 1 also comprises a second light source 12 which is structured so as to emit light when electricity powered, and is arranged within the rear shell 2, in such a position as to project the emitted light only towards the inner surface 11*a* of the reflecting fin 11, so as to backlight the transparent or semitransparent portion of the lenticular half-shell 3 aligned with the reflecting fin 11.

More in detail, in the example shown, the two light sources 4 and 12 preferably but not necessarily consist of two groups of LEDs which are arranged on the two opposite faces of a single support and supply board 14 which is in turn fixed onto the front frame 10, within the cup-shaped body 5, so as to arrange the first group of LEDs facing the inner surface 5*i* of the cup-shaped body 5, and the second group of LEDs facing the inner surface 11*a* of the reflecting fin 11.

The operation of the automotive light 1 is easily inferable from the above description, and requires no further explanations, but for specifying that since the circular or elliptical shape of the light-guiding section-bar 5 made of light-conducting material has no sharp edges, it allows a drastic reduction of the light scattering and absorption phenomena which conversely affect the traditional strips made of light-conducting material, thus allowing portions of front lenticular half-shell 3 being longer than 15 centimeters to be also backlighted, thus keeping the light intensity virtually constant over the whole surface of the portion of front lenticular half-shell 3 to be backlighted.

Finally, it is apparent that changes and variations may be made to the above-described automotive light 1, without departing from the scope of the present invention.

For example, the LED light source 8 may be replaced by a standard incandescent light bulb for automotive use.

The invention claimed is:

1. Automotive light (1) comprising a substantially tub-shaped, rear shell (2) which is structured so as to be fixed to the vehicle body; a front lenticular half-shell (3) which is provided with at least one portion made of either transparent or semitransparent material, and is arranged to close a mouth (2*a*) of the rear shell (2); and at least a first light source (4) which is structured so to emit light when electricity powered, and is located within the rear shell (2) in a position such as to backlight a corresponding transparent or semitransparent portion of the front lenticular half-shell (3);

the automotive light (1) further comprising at least one light-guiding section-bar (6) made of light-conducting material, which is located on the bottom of a corresponding slot or groove (7) specifically realized in the rear shell (2), underneath a corresponding transparent or semitransparent portion of the front lenticular half-shell (3); and at least a second light source (8), which is structured so to emit light when electricity powered, and is located within the rear shell (2), next to at least one of the two ends of the light-guiding section-bar (6), so as to direct the emitted light directly into the body of said light-guiding section-bar (6);

the automotive light (1) being characterized in that the light-guiding section-bar (6) made of light-conducting material has a cross section substantially circular or elliptic in shape, and is provided with a longitudinal flat bevel (6*a*) that faces the bottom of the slot or groove (7), and is structured so as to cause the exit of the light travelling within the light-guiding section-bar (6) towards the transparent or semitransparent portion of the lenticular half-shell (3) overhanging the light-guiding section-bar (6); and by further comprising an intermediate, converging lenticular body (9) which is arranged to close the slot or groove (7) accommodating the light-guiding section-bar (6), so as to be crossed by the light coming out from the elongated slot or groove (7), and is shaped so as to divert/focus/collimate the light rays (r) coming out from the light-guiding section-bar (6) in a new direction locally substantially perpendicular to the surface of the front lenticular half-shell (3).

2. Automotive light according to claim 1, characterized in that said intermediate, converging lenticular body (9) is further shaped so as to divert/focus the light rays (r) coming out from the light-guiding section-bar (6), in, a direction substantially parallel to the optical axis (A) of the automotive light.

3. Automotive light according to claim 1, characterized in that said intermediate, conveying lenticular body (9) is shaped so that its rear face (9*a*) is faced to the light-guiding section-bar (6), and has a convex profile which locally varies according to the shape of the immediately underneath segment of the light-guiding section-bar (6), so that the light rays coming out from the front face (9*b*) of the intermediate lenticular body (9) are locally substantially perpendicular to the surface of the front lenticular half-shell (3).

4. Automotive light according to claim 3, characterized in that said intermediate, converging lenticular body (9) is shaped so that its rear face (9*a*) is faced to the light-guiding section-bar (6), and has a convex profile which also locally varies according to the orientation of the segment of the light-guiding section-bar (6) with respect to the automotive-light optical axis (A), so that the light rays coming from the front face (9*b*) of the intermediate lenticular body (9) are locally substantially parallel to the automotive-light optical axis (A).

5. Automotive light according to claim 1, characterized in that the intermediate, converging lenticular body (9) is further shaped so that its front face (9*b*) is structured so to substantially evenly distribute the light rays coming out from the intermediate, converging lenticular body (9).

6. Automotive light according to claim 5, characterized in that the front face (9*b*) of the intermediate, converging lenticular body (9) is structured so as to randomly diffuse/distribute the light coming out from the body of the light-guiding section-bar (6).

7. Automotive light according to claim 1, characterized in that the slot or groove (7) accommodating the light-guiding section-bar (6) extends into the rear shell (2) substantially along the whole periphery of the shell mouth (2*a*).

8. Automotive light according to claim 7, characterized in that the intermediate, converging lenticular body (9) has a substantially annular shape which substantially copies the shape of said slot or groove (7).

9. Automotive light according to claim 8, characterized in that the light-guiding section-bar (6) extends underneath the front lenticular half-shell (3) substantially along the whole peripheral edge of said half-shell, so as to backlight a corresponding transparent or semitransparent portion of the lenticular half-shell (3) being substantially annular in shape.

10. Automotive light according to claim 1, characterized in that the automotive light (1) is further provided with at least one cup-shaped body (5), which is recessed within the rear shell (2) with the concavity facing a corresponding transparent or semitransparent portion of the front lenticular half-shell (3); and in that said first light source (4) is located next to the bottom of the cup-shaped body (5).

11. Automotive light according to claim 8, characterized in that the cup-shaped body (5) is shaped so as to be recessed within a central portion of the rear body (2) delimited by the slot or groove (7), and in that the intermediate, converging lenticular body (9) consists of a protruding peripheral flange (9) which juts out of the mouth (5*a*) of the cup-shaped body (5) to cover the immediately adjacent entrance of the elongated slot or groove (7).

12. Automotive light according to claim 11, characterized in that the intermediate, converging lenticular body (9) is realized in one piece with the cup-shaped body (5), and in that the cup-shaped body (5) consists of a half-shell (5, 9) which is entirely made of a transparent or semitransparent material, and has at least a part of its inner convex surface (5*i*) mirror finished so to reflect the incident light towards the transparent or semitransparent portion of the front lenticular half-shell (3) to be backlighted by said first light source (4).

* * * * *